US011089922B2

(12) United States Patent
Steigerwald

(10) Patent No.: US 11,089,922 B2
(45) Date of Patent: Aug. 17, 2021

(54) PORTABLE TOILET STALL

(71) Applicant: Norbert Steigerwald, Schoellkrippen (DE)

(72) Inventor: Norbert Steigerwald, Schoellkrippen (DE)

(73) Assignee: ADCO UMWELTDIENSTE HOLDING GMBH, Ratingen (DE)

( * ) Notice: Subject to any disclaimer, the term of this patent is extended or adjusted under 35 U.S.C. 154(b) by 0 days.

(21) Appl. No.: 16/558,251

(22) Filed: Sep. 2, 2019

(65) Prior Publication Data

US 2020/0077847 A1 Mar. 12, 2020

(30) Foreign Application Priority Data

Sep. 6, 2018 (EP) ..... 18193025

(51) Int. Cl.
*A47K 11/02* (2006.01)
*E04H 1/12* (2006.01)

(52) U.S. Cl.
CPC ..... *A47K 11/02* (2013.01); *E04H 1/1216* (2013.01)

(58) Field of Classification Search
CPC ..... A47K 11/02; A47K 11/00; A47K 3/284; E04H 1/1216; B64D 11/02; B60R 15/02; B60R 15/04
USPC ..... 4/602, 603
See application file for complete search history.

(56) References Cited

U.S. PATENT DOCUMENTS 4,163,294 A * 8/1979 Patterson ..... A47K 11/02 4/449
6,128,787 A * 10/2000 Krist ..... E03D 11/146 4/252.2
6,438,902 B1 * 8/2002 Muller ..... E04H 1/1216 4/460
6,507,958 B1 * 1/2003 Tagg ..... A47K 11/02 4/321
6,823,538 B2 * 11/2004 Leclercq ..... A47K 4/00 4/664
2004/0003461 A1 * 1/2004 Leclercq ..... B63B 29/14 4/664

FOREIGN PATENT DOCUMENTS

DE 19500561 A 7/1996
DE 19803719 A 10/1998
DE 202016101186 U 4/2017
EP 3249136 A 11/2017

* cited by examiner

*Primary Examiner* — Janie M Loeppke
(74) *Attorney, Agent, or Firm* — Andrew Wilford

(57) ABSTRACT

A portable toilet stall for a sanitary fixture has a floor, a roof above the floor, and a plurality of upright posts extending between the roof and the floor. At least one of the posts is hollow. A plurality of side wall panels are provided between the posts and also between the roof and the floor. There is a rinse-liquid tank inside the hollow support post and connected to the sanitary fixture.

16 Claims, 4 Drawing Sheets

PORTABLE TOILET STALL

FIELD OF THE INVENTION

The present invention relates to a sanitary installation. More particularly this invention concerns a portable toilet stall.

BACKGROUND OF THE INVENTION

A typical portable toilet stall has a floor, a roof, a plurality of support posts extending vertically at corners between the floor and the roof, and a plurality of side wall panels between the posts. Such a toilet stall is mobile or transportable toilet and can be transported on a truck for use, for instance where no permanent toiled facilities are available. The mobile toilet stalls are therefore usually set up for certain periods of time, for example at construction sites or events such as fairs, festivals, markets, and the like. The mobile or transportable toilet stalls are then transported away and cleaned.

Various versions of toilet stalls of the type described above are known from practice as a basic principle. Many of the toilet stalls that are known from practice have a sanitary device, for example a toilet. After use of the toilet, the feces are sent directly to a waste tank without subsequent rinsing. The toilet or the toilet seat can be provided directly above the waste tank for this purpose. In principle, such toilet stalls have proven their worth in terms of their compactness and flexible deployability. However, they are to be not very comfortable for the user, since the toilet is not rinsed after use and also because it is not possible to wash one's hands with water in the toilet stall. It is therefore also known to use liquid and/or freshwater tanks in mobile toilet stalls in order to make the use of them more comfortable and hygienic. Due to the additional freshwater tanks, however, these toilet stalls often have an unwieldy construction, making them complicated and difficult to transport in addition to limiting their flexibility of use. Furthermore, the assembly of the toilet stalls with liquid and/or freshwater tank that are known from practice is usually very time-consuming. Another problem with the toilet stalls having a rinse water or freshwater supply that are known from practice is that the tanks are easily accessible in many cases and that liquid in the tanks can be contaminated by external influences or vandalism.

Objects of the Invention

It is therefore an object of the present invention to provide an improved a portable toilet stall.

Another object is the provision of such an improved a portable toilet stall that overcomes the above-given disadvantages, in particular that avoids the above problems and in which comfortable use is made possible by provision of a liquid in combination with a compact design and easy assembly and handling of the toilet stall.

SUMMARY OF THE INVENTION

A portable toilet stall for a sanitary fixture has according to the invention a floor, a roof above the floor, and a plurality of upright posts extending between the roof and the floor. At least one of the posts is hollow. A plurality of side wall panels are provided between the posts and also between the roof and the floor. There is a rinse-liquid tank inside the hollow support post and connected to the sanitary fixture.

In the context of the invention, "rinse-liquid tank" refers particularly to a reservoir or supply vessel for liquid. It is possible for the interior of the hollow support post to form the rinse-liquid tank directly. In the context of the invention, "liquid" refers particularly to rinse water or fresh water. The rinse-water tank according to the invention is therefore preferably a freshwater reservoir or tank. According to one embodiment of the invention, the rinse water or fresh water can be provided with additives, for example with fragrances, disinfectants, and the like. In principle, non-aqueous fluids can also be used as rinse liquid. However, the use of water or fresh water as the liquid is especially preferred.

Here and below, reference is made particularly to the vertical, installed state of the toilet stall according to the invention in which the floor is provided on an underlying support surface and in which the roof is located above the floor. In the context of the invention, the terms "horizontal" and "vertical" refer particularly to this vertical installed state of the toilet stall according to the invention.

One preferred embodiment of the invention is characterized in that at least one of the support posts is a corner post. According to one embodiment of the invention, all of the support posts of the toilet stall are corner posts, and the toilet stall preferably has four support or corner posts at corners of the generally square (in top view) roof and floor.

It is recommended that at least some of the support posts or corner posts, preferably all of the support posts or corner posts, of the toilet stall are formed of one single injection-molded piece of plastic along their full longitudinal extension.

It is recommended that a tongue-and-groove connection be provided between each support or corner post and the roof and/or the floor. It has proven effective if each of the support posts and/or corner posts has at its end a tenon that interacts with a complementary mortise groove on the roof or on the floor by engaging in this groove. According to an especially preferred embodiment, the tongue-and-groove connection elements that are provided for the tongue-and-groove connection to the support post and/or corner post and to the roof and/or floor each have mutually aligned holes. In this way, the respective support post and/or corner post can be connected to the roof and/or to the floor by at least one connecting element that engages through the mutually aligned holes. Advantageously, such a connecting element is a connecting bolt or a connecting screw.

According to an embodiment of the invention that has proven advantageous, four support posts and/or corner posts of the toilet stall each have at least one tenon, preferably only one tenon. Advantageously, the roof and/or the floor each have four grooves for interacting with the associated four tenons of the four support/corner posts. It is recommended in this context that the mutually aligned holes and the connecting elements formed by the mortises and tenons and engaging through these holes be provided at each tongue-and-groove connection between the support post and/or corner post and the roof and/or floor. One highly recommended embodiment of the toilet stall according to the invention is characterized in that a connecting screw engages in the manner of a connecting element through the mutually aligned holes of the respective tenon and the associated groove, and that, from the interior of the toilet stall outward, at least one nut is screwed onto the thread of the connecting screw in order to secure the tongue-and-groove connection.

It has proven advantageous for a side wall panel of the toilet stall to connect two support posts and/or corner posts to one another. In order to produce this connection, tongue-and-groove connections are preferably set up between the edges of each side wall panel and the two support posts and/or corner posts flanking it. For this purpose, each side wall panel advantageously has at least one respective tongue or ridge on each of its vertical outer edges facing toward the support posts and/or corner posts that engages in a complementary groove of the support or corner post. The at least one tongue then extends over at least a majority of the vertical length of the side wall panel. Accordingly, the complementary groove in the support post and/or corner post that is associated with the tongue preferably also extends over at least a majority of the vertical length of the post. In a preferred toilet stall with four support posts and/or corner posts, it has proven advantageous if, in three of these posts, two respective posts are interconnected by a side wall panel, in which case a tongue-and-groove connection, very especially preferably the tongue-and-groove connection described above, is advantageously provided between the support or corner post and the side wall panel. The floor and/or the roof also have on their horizontal edges associated with the upper and lower horizontal edges of the respective side wall panels groove-type recesses into which tongues of the side wall panel can engage. Especially preferably, a side wall panel engages by a tongue-and-groove connection with its lower edge in the associated groove-type recess of the floor and with its upper edge in an associated groove-type recess of the roof.

The preferred embodiment of the toilet stall according to the invention with four support posts and/or corner posts is a four-sided toilet stall with three side wall panels. It is advantageous for the fourth side of the toilet stall to be configured such that a toilet stall door is provided between two support or corner posts. The toilet stall door is preferably attached, particularly by hinges, to one of the two support posts or corner posts. According to another preferred embodiment of the invention, the toilet stall door is pivoted on a door rod, with the door rod preferably extending from the floor to the roof of the toilet stall and engaging in respective seats in the floor and the roof of the toilet stall, and with the door rod being especially preferably provided adjacent to or immediately adjacent one of the two support posts or corner posts. It has proven advantageous if a jamb be then provided for the toilet stall door on the other of the two support posts or corner posts of the fourth side of the toilet stall with which the toilet stall door can be locked by at least one toilet stall lock.

According to an especially recommended embodiment of the invention, the toilet stall is rectangular or square in plan view. The toilet stall, being rectangular or square in plan view, preferably has rounded edges, for which purpose the corner posts of the toilet stall are preferably rounded on their outer sides. It lies within the scope of the invention for the side wall panels of the toilet stall according to the invention to be made of plastic and particularly to be one-piece plastic parts. Especially preferably, the toilet stall door is also made of plastic.

One embodiment that is of very special importance in the context of the invention is characterized in that at least some of the support posts are corner posts and that at least one of the corner posts is preferably hollow at least in some portions and has the rinse-liquid tank in its interior. In principle, it also lies within the scope of the invention for a plurality of cavities to be provided in a support or corner post.

According to an especially preferred embodiment, four support posts and/or corner posts are provided at four corners of the toilet stall and preferably at least two, more preferably all four corner posts are at least partially hollow. It is recommended that a rinse-liquid tank be provided inside at least one, preferably in at least two of the hollow corner posts. It is very especially preferred if a rinse-liquid tank is provided inside two of the hollow corner posts. Preferably, a vent fan is provided inside at least one of the other two hollow corner posts. It also lies within the scope of the invention for a vent fan to be provided inside at least two of the other hollow corner posts. One embodiment that is especially preferred in this context is characterized in that a rinse-liquid tank is provided in the interior of the two front hollow corner posts, and that a vent fan is provided in the interior of the two back hollow corner posts.

It lies within the scope of the invention for the vent fan to have at least one exhaust duct or to be embodied in the form of at least one exhaust duct. According to one embodiment, the interior of the hollow corner post advantageously forms an exhaust duct of the vent fan. For this purpose, the hollow corner post or the interior of the hollow corner post can be connected via an intake port or opening to the interior of the toilet stall and/or to the waste tank, so that the exhaust air is able to travel from the toilet stall interior or from the waste tank into the hollow corner post. It is recommended that this corner post or the interior of the corner post then have an additional outwardly open port through which the exhaust air can exit to the environment or by means of which the interior of the post is connected to the outside or outside environment of the toilet stall. The two above-described openings for removing the exhaust air can also be provided as a plurality of openings or perforations. It also lies within the scope of the invention for the exhaust device to have an electrically operated fan. Advantageously, such a fan is provided in the interior of the hollow support or corner post that has the vent fan and can support a chimney effect of the interior, for example, in order to ventilate the toilet stall and/or waste tank. Such a fan can be powered by a solar panel, for example, that is mounted on the outside of the roof of the toilet stall. It is recommended that the at least one hollow corner post having the at least one vent fan in its interior have a corner post that is provided in the vicinity of at least one sanitary device of the toilet stall and/or in the vicinity of the waste tank of the toilet stall. This is advantageously is a back corner post that is associated with the rear side of the toilet stall and/or provided on the rear side of the toilet stall. It is recommended that such a back support or corner post that is provided on the rear side of the toilet stall be provided across from the toilet stall door and thus not be part of the front side of the toilet stall on which the toilet stall door is provided.

According to a highly preferred embodiment, if two of the hollow corner posts of the toilet stall have a rinse-liquid tank and another of the hollow corner posts has a vent fan, then a fourth of the hollow corner posts is provided with at least one electrically operated functional device in its interior. Such an electrically operated functional device can be a ventilation device or a fan, a lighting device, a loudspeaker box, a fragrance dispenser, or the like. According to one embodiment, such an electrical functional device can be powered by a rechargeable battery and/or by the solar panel already mentioned above and/or by an external power source. Furthermore, it also lies within the scope of the invention for an electrically operated functional device to be provided in a hollow support post that already has a rinse-liquid tank and/or a vent fan. For this purpose, the electrically operated functional device can be provided in the same internal space or in a separate internal space of the hollow support or corner post if a plurality of spaced are formed in a support or corner post.

Preferably, the at least one interior or one interior extends in the longitudinal direction of the support or corner post. It is recommended that the hollow support or corner post be hollow over at least 40% of its length L, preferably over at least 50% of its length L. According to another preferred embodiment, the hollow support or corner post is hollow over at least 60% of its length L, preferably over at least 70% of its length L, especially preferably over at least 80% of its length L. In this context, "length L" refers particularly to the longest extension of the support or corner post in the longitudinal direction. According to one embodiment of the invention, the interior is closed on all sides by walls of the post. The interior of the hollow support or corner post preferably constitutes at least 30%, more preferably at least 40%, very preferably at least 50%, and especially preferably at least 60% of the horizontal cross-sectional area thereof, with the wall of the support or corner post constituting the remainder of the cross-sectional area. It is very especially preferred if the hollow portion constitutes at least 70%, preferably at least 75% of the cross-sectional area. The above-described proportions of the interior in the cross-sectional area of a support or corner post advantageously extend over at least 40%, preferably over at least 50%, and very preferably over at least 60% of the vertical length of the interior of the support or corner post.

One embodiment that is of very special importance in the context of the invention is characterized in that the at least one rinse-liquid tank extends over the length L of the hollow support or corner post only in some portions. Preferably, the at least one rinse-liquid tank extends over 10% to 90%, preferably over 20% to 80%, especially preferably over 30% to 70%, and very especially preferably over 35% to 65% of the length L of the hollow support or corner post.

It lies within the scope of the invention for the at least one rinse-liquid tank of the hollow support or corner post to extend along the entire vertical length of the interior. An alternative embodiment of the invention is characterized in that the at least one rinse-liquid tank of the hollow support or corner post extends over the vertical length of the interior of the hollow support or corner post only in some portions. It is possible for the support or corner post to have a larger horizontal cross-sectional area in the vicinity of the rinse-liquid tank than in the region without a rinse-liquid tank.

According to a highly recommended embodiment of the invention, the rinse-liquid tank is provided in a portion of the support or corner post that faces toward the floor of the toilet stall. According to a preferred embodiment, if the at least one rinse-liquid tank extends over the length L of the hollow support or corner post only in some portions, then the rinse-liquid tank is preferably provided in a region of the support or corner post closer to or adjacent the floor. This embodiment is based inter alia on the discovery that, if the rinse-liquid tank is provided in the lower region of the support or corner post adjacent the floor, the center of gravity of the toilet stall is shifted downward toward the underlying support surface, particularly if the rinse-liquid tank is filled with liquid. In this way, the toilet stall is additionally protected against toppling or falling over, for example as a result of tampering or weather conditions.

It lies within the scope of the invention for a rinse-liquid tank to have at least one output connection, preferably with an outlet conduit. The liquid can flow out of the rinse-liquid tank via such an output connection or via the outlet conduit, which is preferably connected to the output connection, and used in the toilet stall. Very especially preferably, the output connection is provided in the vicinity of the lower end of the rinse-liquid tank or of the corner post. The term "lower end" refers to the vertical, set-up state of the toilet stall, so the lower end of the rinse-liquid tank or of the corner post refers particularly to the end of the rinse-liquid tank or of the corner post adjacent the floor. It is recommended that the output connection be provided on the underside of a support or corner post that contains a rinse-liquid tank and is adjacent the floor.

Another embodiment of the invention that has proven advantageous is characterized in that the outlet conduits of at least two rinse-liquid tanks present in the support posts or corner posts are interconnected via at least one coupling. According to an especially preferred embodiment, the coupling is a tee. The outlet conduits are then preferably connected to two ends of the tee, and the combined liquid can continue to flow through a third supply line connected to the tee so the liquid can subsequently be used in the toilet stall. In principle, it is also possible for the outlet conduits to be interconnected to a plurality of rinse-liquid tanks, e.g. three rinse-liquid tanks, that are present in the support posts via a corresponding coupling.

If a plurality of rinse-liquid tanks are provided in the toilet stall, is also possible in principle for no coupling of the outlet conduits of these rinse-liquid tanks to take place, in which case the outlet conduits are each advantageously associated separately to a sanitary device that is preferably provided in the toilet stall. This embodiment is based on the discovery that, in this way, different liquids, or liquids with different additives, can be used for the individual sanitary devices of the toilet stall.

It is recommended that at least one sanitary device, in particular a toilet and/or a urinal and/or a sink, be provided in the toilet stall. Advantageously, the at least one sanitary device is connected to the at least one rinse-liquid tank, more particularly with the outlet conduit of a rinse-liquid tank, so that the sanitary device can be rinsed or supplied with liquid. According to an especially preferred embodiment, if the outlet conduits of at least two rinse-liquid tanks that are present in the support posts or corner posts are connected to one another by a coupling, particularly a tee, then the at least one sanitary device is preferably connected to the supply line continuing after the tee.

Advantageously, the pump is provided between a rinse-liquid tank, more particularly the outlet conduit of a rinse-liquid tank, and the at least one sanitary device. Such a conveying device or pump can be powered by the above-described solar panel and/or by a rechargeable battery and/or an external power source, for instance. According to an alternative embodiment of the invention, the conveying device or the pump is a mechanically actuatable conveying device or pump, for example a foot pump that can be actuated particularly by a user of the toilet stall. According to a preferred embodiment, if the outlet conduits of a plurality of rinse-liquid tanks are connected to one another by at least one coupling, then the conveying device for conveying the liquid, particularly the pump, is provided in the direction of flow of the liquid downstream of the coupling. This makes it possible for the liquid to be conveyed with the conveying device or pump from a plurality, particularly from two interconnected rinse-liquid tanks.

In the context of the invention, the liquid is thus conducted out of the rinse-liquid tank, especially preferably due to the conveying action of the conveying device or pump, via at least one output connection and an outlet conduit that is preferably connected to the output connection in the direction of the sanitary device. The liquid is preferably combined by a plurality of, especially preferably by two, rinse-liquid tanks by a coupling, after which the liquid flows to at least one sanitary device. With the liquid, a toilet bowl can be rinsed and/or a urinal be rinsed and/or a hand-washing sink supplied with liquid, thus enabling the user to wash their hands in the hand-washing sink with the liquid.

Moreover, it also lies within the scope of the invention for the conveyor to be hydraulically operated or set up as a hydraulic pump and operate in the course of the opening or closing of the toilet stall door. Preferably, no power supply is then required for the conveying device.

As was already mentioned above, in the preferred embodiment with a plurality of rinse-liquid tanks, particularly with two rinse-liquid tanks, these rinse-liquid tanks or the outlet conduits thereof do not necessarily have to be connected via a coupling. In principle, it is also possible for each of the two rinse-liquid tanks to supply a respective sanitary device in the toilet stall with liquid. Two conveying devices or two pumps for conveying the respective liquid can then also be optionally provided in the toilet stall. In the context of such an embodiment, two different liquids, or liquids with different additives, can then be preferably used. This is particularly advantageous if one of the sanitary devices is a toilet bowl and/or a urinal and another sanitary device is a hand-washing sink.

One very especially preferred embodiment of the invention is characterized in that a rinse-liquid tank has at least one fill port, preferably one fill port, with the fill port being especially preferably provided in the interior of the toilet stall and with the fill port being very especially preferably provided in the vicinity of the upper end of the rinse-liquid tank. In the context of the invention, "fill port" refers to an opening through which liquid can be introduced into the rinse-liquid tank. According to an embodiment that has proven advantageous, the fill port is provided inside the toilet stall. In this context, the upper end of the rinse-liquid tank means the end of the rinse-liquid tank that faces away from the floor. According to a preferred embodiment, if the horizontal cross-sectional area of the hollow support or corner post in the vicinity of the at least one rinse-liquid tank is greater than in the region in which no rinse-liquid tank is present, a top surface of the rinse-liquid tank is created according to a recommended design variant at the upper end of the rinse-liquid tank, and the fill port is preferably provided in or on this final top surface of the rinse-liquid tank. Very especially preferably, the at least one fill port of the rinse-liquid tank is then provided opposite the output connection, which is preferably provided in the vicinity of the lower end of the rinse-liquid tank.

It lies within the scope of the invention for the fill port to be closable by at least one closure element. Preferably, the closure element is a screw plug with a closure lid and a fitting. The fitting is recommendably fixed or screwed to the support or corner post by fastening elements. Very especially preferably, the screw plug has an external thread that fits with a complementary internal thread of the fitting when the screw plug is in the closed state. In order to seal the fill port in the context of such an embodiment, the closure lid is screwed with its external thread into the complementary internal thread of the fitting, and the closure lid is unscrewed from the fitting in order to open the screw plug. In this way, it is possible to securely seal the fill port of a rinse-liquid tank while simultaneously ensuring that the rinse-liquid tanks can be filled with liquid easily and without much effort by the maintenance staff. The design of the closure element as a screw plug with closure lid and fitting also makes it possible to prevent a rinse-liquid tank from being opened by an unauthorized person. The closure lid that is preferably provided with an external thread is sunk or substantially sunk, as it were, into the fitting through the screwing into the complementary internal thread of the fitting, so that increased effort is required in order to unscrew the closure lid from the fitting or to open the screw plug. In principle, the closure lid can also have an internal thread and the fitting can have a complementary external thread.

It is recommended that the closure element, particularly the closure lid of the screw plug, have an actuating formation for opening and closing the closure element or the screw plug. Especially preferably, the actuating formation is a longitudinal groove and/or as a cross groove formed by two longitudinal grooves that are offset by 90°, and an opening tool such as a screwdriver, a coin, or the like can engage in this longitudinal groove or cross groove, thus enabling the closure lid to be unscrewed from the fitting. In principle, it also lies within the scope of the invention for the closure element to be a simple seal plug that is pressed into the fill port and seals it. One embodiment of the invention is characterized in that the closure element is a cover with cam lock, the cam lock preferably interacting with the corner post or the top surface of the rinse-liquid tank and preferably being secured with a lock.

According to another preferred embodiment of the invention, in addition to the output connection of the rinse-liquid tank, a outlet connection is provided on the rinse-liquid tank for emptying the rinse-liquid tank via a valve or through which outlet connection residual water can be removed from the rinse-liquid tank. The outlet connection is preferably provided on the underside or the side of the rinse-liquid tank adjacent the floor.

One highly preferred embodiment of the invention is characterized in that the rinse-liquid tank has a capacity of between 5 L and 100 L, preferably between 10 L and 70 L, more preferably between 15 L and 60 L, and especially preferably between 30 L and 55 L. If the toilet stall has a plurality of rinse-liquid tanks, for example, two rinse-liquid tanks according to a preferred embodiment, in hollow support posts or corner posts, it is recommended that the rinse-liquid tanks have the same capacity or substantially the same capacity. In principle, however, it is also possible for the rinse-liquid tanks to be of a different size or have a different capacity.

It lies within the scope of the invention for the toilet stall to have a toilet stall door on its front side and for at least one hollow support or corner post to be provided on the front side next to the door, a rinse-liquid tank being provided in this at least one hollow support or corner post. Very especially preferably, both of the front-side support or corner posts that are provided next to the door are hollow and each have a rinse-liquid tank. It is recommended in that case that at least one of the back support posts or corner posts that are provided opposite the door or toilet stall door is likewise hollow and has at least one vent fan in the interior. According to a preferred embodiment, the support posts or corner posts and/or the floor and/or the roof and/or the side wall panels are made of plastic or substantially of plastic.

It was already mentioned at the outset that the toilet stall according to the invention according to the preferred embodiment is a mobile or a portable toilet stall. Accordingly, the toilet stall according to the invention is set up with a relatively compact construction, and it lies within the scope of the invention for the volume of the interior of the toilet stall to be only 1 to 4 $m^3$, preferably 1.25 to 3.5 $m^3$, and especially preferably 1.25 to 3 $m^3$.

The invention is based on the discovery that the toilet stall according to the invention allows for comfortable and hygienic use by supplying the toilet stall or the at least one sanitary device that is provided within the toilet stall with liquid and/or fresh water. By virtue of the liquid that is available in the at least one rinse-liquid tank, it is possible on the one hand to for sanitary devices such as a toilet bowl and/or a urinal to be rinsed with liquid and, on the other hand, for a hand-washing sink to be supplied with liquid and/or fresh water, so that the user of the toilet stall can wash their hands in the hand-washing sink. In that regard, the toilet stall according to the invention is characterized by a high level of comfort for the user. It should be emphasized that the inventive arrangement of rinse-liquid tanks makes this comfortable use of the toilet stall possible while simultaneously providing a compact design and extremely flexible deployability of the toilet stall. The special arrangement of a rinse-liquid tank in the interior of the hollow support or corner post enables liquid or fresh water to be provided without adversely affecting the compact design of the toilet stall. It should also be noted that the special arrangement of the at least one rinse-liquid tank additionally stabilizes the toilet stall and prevents it from falling over. Moreover, a rinse-liquid tank according to the invention is barely visible to the user, and if the rinse-liquid tank is sealed with a screw plug according to a preferred embodiment, the rinse-liquid tank is reliably protected against external influences and contaminations associated therewith. It should also be noted that the advantages described above are achieved by simple and less complex measures and that the toilet stall according to the invention is also characterized by high cost efficiency and ease of manufacture. Finally, the assembly of the toilet stall according to the invention is surprisingly simple, since an inventive rinse-liquid tank is provided in a component of the toilet stall that is required anyway, so no separate rinse-liquid tank needs to be assembled.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
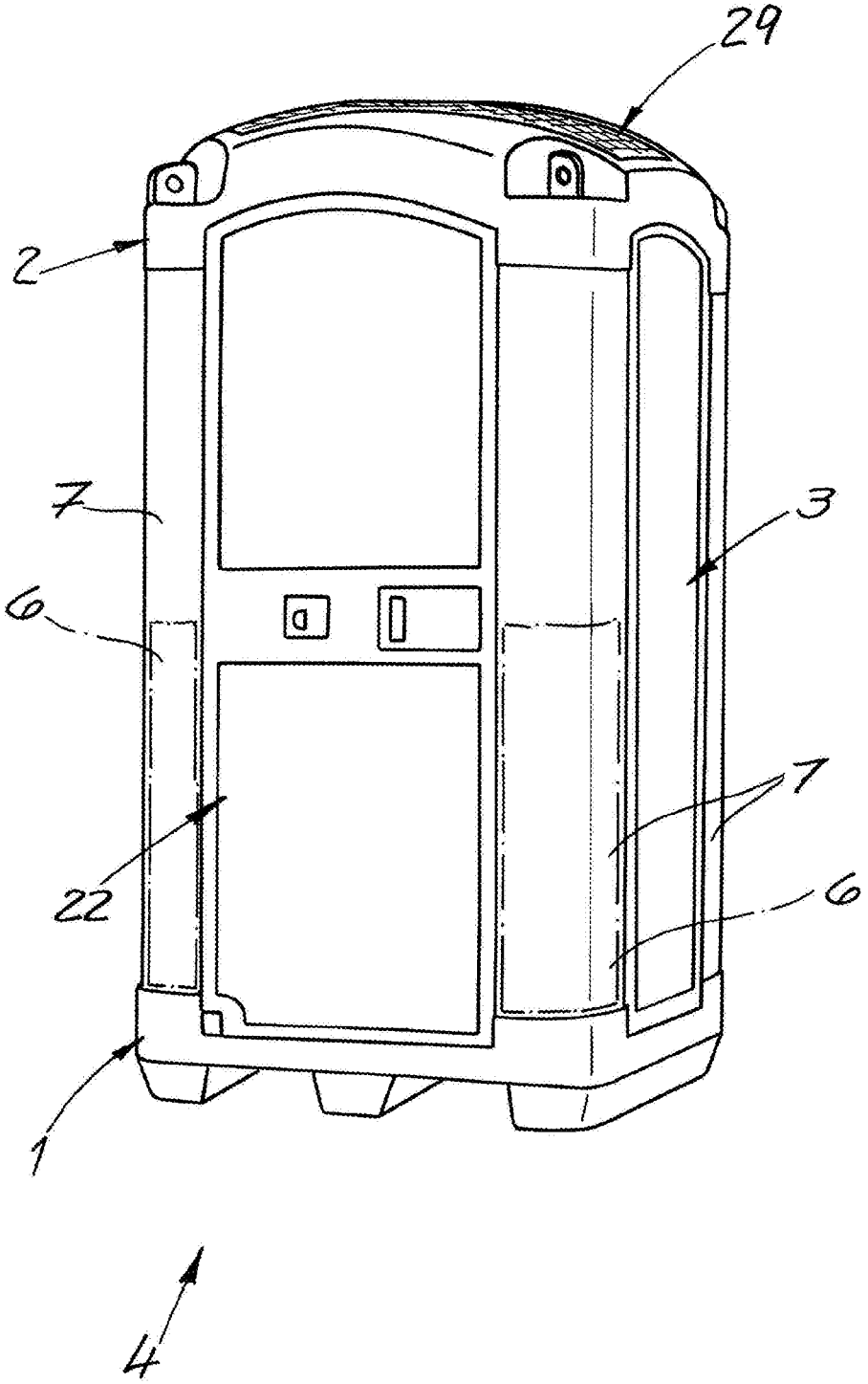
FIG. 1 is a small-scale perspective view of a toilet stall according to the invention.
Figure 2:
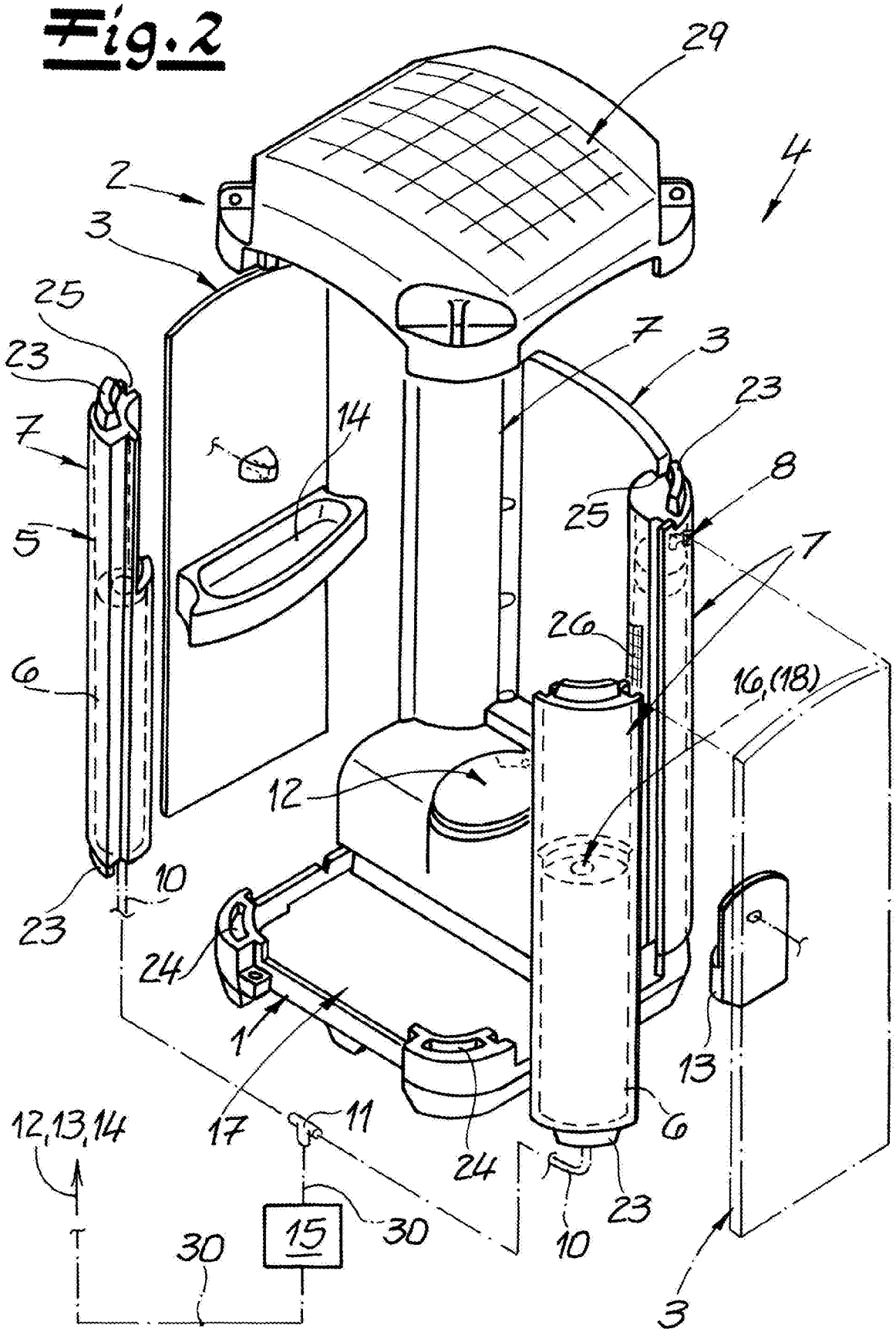
FIG. 2 is an exploded view of the toilet stall of FIG. 1.

As shown in FIGS. 1 and 2 a toilet stall 4 according to the invention has a basically square floor 1, a basically square roof 2, and three side wall panels 3. A door 22 closes a fourth side. Four upright support or corner posts 7 extend vertically between corners of the floor 1 and of the roof 2 that are also interconnected by the side panels 3.

The four corner posts 7 are each equipped at both ends with a projecting tenon 23 for connection to the floor 1 and to the roof 2. Preferably, both the floor 1 and the roof 2 each have at each corner a complementary mortise or groove 24 for receiving the respective tenon 23 of the corner post 7. This can be seen particularly in FIG. 2. The corner posts 7 are also provided with grooves 25 on their outer sides facing toward the side wall panels 3 for a similar tongue-and-groove connection with the outer edges of the side wall panels 3. In this way, three side wall panels 3 are connected to the corner posts 7 by tongue-and-groove connections. Moreover, the floor 1 and the roof 2 are preferably also provided on their edges abutting edges of the side wall panels 3 with a groove or recess in which the side wall panel 3 can engage. This is not shown in detail. A side wall panel 3 thus engages by a tongue-and-groove connection with its lower edge in the associated groove-type recess of the floor 1 and with its upper edge in a respective groove-type recess of the roof 2. As described, the side wall panels 3 engage with their outer edges in grooves 25 of the corner posts 7. It also lies within the scope of the invention for the corner posts 7 to be one-piece plastic parts in the direction of their vertical longitudinal extension.

FIG. 1 shows that the toilet stall door 22 is advantageously provided on the front side of the toilet stall according to the invention, and this toilet stall door 22 is pivoted on one of corner posts 7 by unillustrated hinges. According to a preferred embodiment, a toilet bowl 12, a urinal 13, and a hand-washing sink 14 are provided in an interior 17 of the toilet stall 4.

According to the invention, at least one support or corner post 7 of the toilet stall 4 is at least partially hollow to form a space 5, and at least one rinse-liquid tank 6 is provided in the space 5. The liquid that is provided in the rinse-liquid tank 6 is preferably rinse water or fresh water. Here according to the figures, four corner posts 7 are provided at the four corners of the toilet stall 4 and, preferably, all four corner posts 7 are hollow at least in some portions. Advantageously, a rinse-liquid tank 6 is provided in the interior 5 in two of the hollow corner posts 7. Very especially preferably, a respective rinse-liquid tank 6 is provided in the interior 5 in the two corner posts 7 that are provided on the front side next to the toilet stall door 22. Advantageously, a vent fan 8 is provided in the interior 5 in at least one other of the hollow corner posts 7. This is the corner post 7 opposite the door 22 and thus on the rear side of the toilet stall. The vent fan 8 can be embodied, for example, as an exhaust duct with an intake port 26 consisting of a plurality of perforations on the inside of respective post 7 and an opening (not shown in further detail) for venting the exhaust air away outside the toilet stall.

Figure 3:
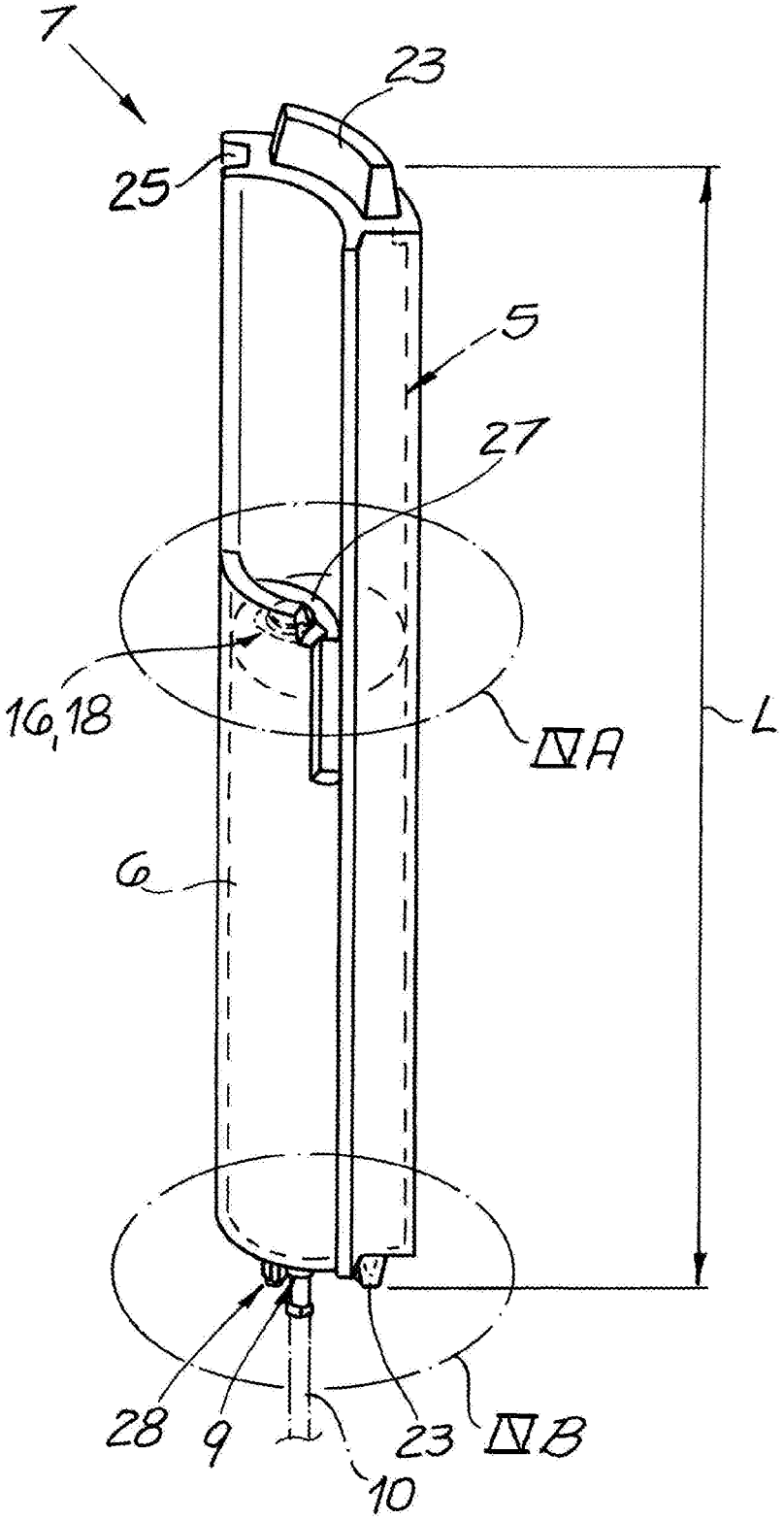
FIG. 3 is a detail view of a support or corner post of the stall.
Figure 4A:
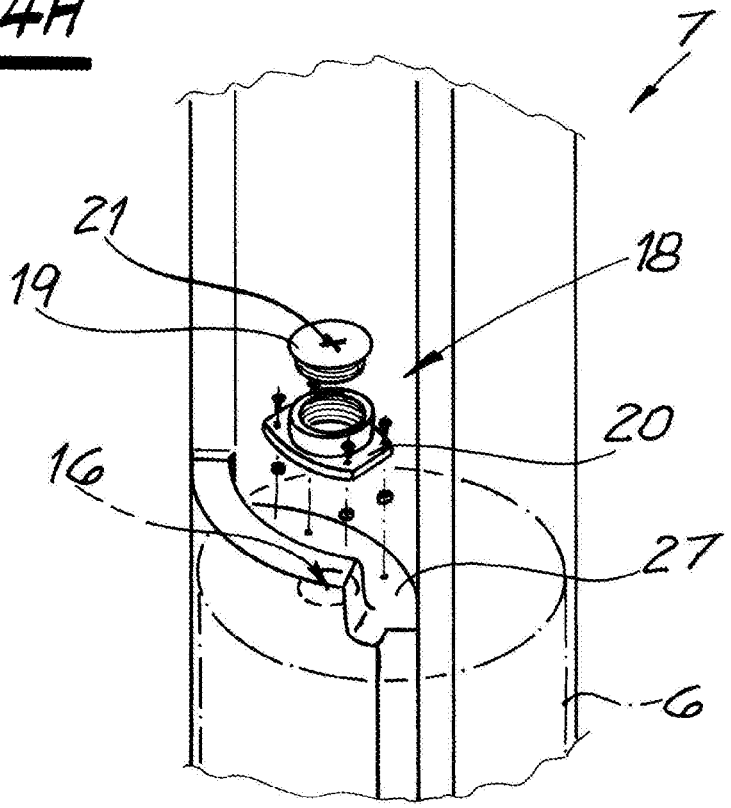
FIGS. 4A and 4B are large-scale views of the details indicated at IVA and IVB in FIG. 3.
Figure 4B:
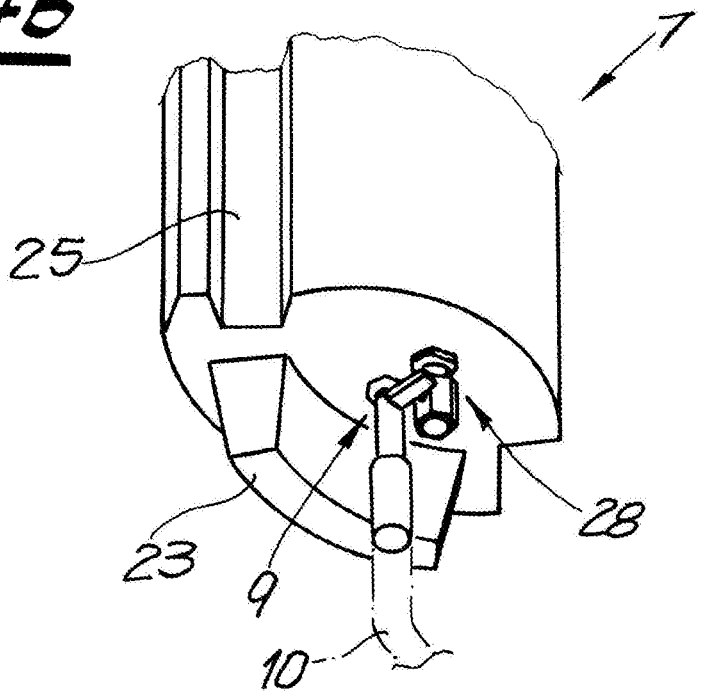

Preferably, the hollow corner post 7 is hollow on the inside over at least 40% of its length L. It is recommended that the at least one rinse-liquid tank 6 extend over part of the length L of the hollow support or corner post 7. Preferably, the tank 6 extends over from 30% to 70% of the length L of the hollow corner post 7. Here according to the figures, the rinse-liquid tank 6 may extend over approximately 50% of the length L of the hollow support post. This can be seen particularly in FIG. 3. The rinse-liquid tank 6 is provided in a lower portion of the corner post 7 adjacent the floor 1.

Preferably, the rinse-liquid tank 6 has an output connection 9 to which an outlet conduit 10 is connected. The output connection 9 is provided in the vicinity of the lower end of the rinse-liquid tank 6 or of the corner post 7. In this context, "lower end" refers particularly to the end of the rinse-liquid tank 6 or of the corner post 7 adjacent the floor 1. Advantageously, and here according to the figures, two of outlet conduits 10 of the two rinse-liquid tanks 6 that are present in the corner posts 7 are interconnected by a coupling 11, here a tee. The liquid from the two rinse-liquid tanks 6 can then flow via the output connections 9 and the outlet conduits 10 to the coupling 11 where the two rinse-liquid tanks are coupled together and flow can advantageously continue via a supply line 30.

As described above, the toilet bowl 12, urinal 13, and sink 14 are provided in the toilet stall 4. These sanitary devices 12, 13, 14 are connected to the rinse-liquid tanks 6 via the outlet conduits 10 so that the sanitary devices 12, 13, 14 can be rinsed and/or supplied with liquid. At least one pump 15 for conveying the liquid is provided between the rinse-liquid tank 6 or the outlet conduits 10 of the rinse-liquid tank 6 and the sanitary devices 12, 13, 14. The pump 15 is provided downstream of the coupling 11 in the direction of flow of the liquid, so that the pump 15 conveys the liquid from both rinse-liquid tanks 6. This is shown schematically in FIG. 2. The combined liquid can then flow to the individual sanitary devices 12, 13, 14 and supply these sanitary devices with liquid, particularly rinse water or fresh water.

Preferably, the rinse-liquid tanks 6 each have a fill port 16, accessible from the interior 17 of the toilet stall 4. Recommendably, the fill port 16 is also provided in the vicinity of the upper end of each rinse-liquid tank 6. Advantageously, the horizontal cross-sectional area of a corner post 7 that is provided with a rinse-liquid tank 6 is larger in the vicinity of the rinse-liquid tank 6 than in the region of the corner post 7 that does not have the rinse-liquid tank 6. The rinse-liquid tank 6 then advantageously has on its upper side a final top surface 27, and the fill port 16 is provided in or on this top surface 27.

Advantageously, the fill port 16 can be closed by a closure element formed as a screw plug 18 with a lid 19 and a fitting 20. The fitting 20 is attached by screws to the corner posts 7. Preferably, the closure plug 18 has an external thread that interacts with a complementary internal thread of the fitting 20 when the screw plug 18 is closed. In order to open or close the screw plug 18, the closure lid 19 is thus unscrewed from the fitting 20 or screwed into the fitting 20. It is recommended that the closure lid 19 of the screw plug 18 have an actuating formation 21 for opening and closing the screw plug 18. Here, the actuating formation 21 is a cross groove with two longitudinal grooves that are mutually offset by 90°. The closure lid 19 can then be unscrewed from the fitting 20 by an opening tool, such as a Phillips-head screwdriver or the like, or screwed into the fitting 20.

In the context of the invention, in addition to the outlet connection 9, another outlet connection 28 is provided on the underside of a corner post 7 that is provided with a rinse-liquid tank 6 adjacent the floor 1 via which residual water, for example, can be drained from the rinse-liquid tank 6, advantageously via a valve.

Very especially preferably, the toilet stall 4 the toilet stall door 22 on its front side, with two front corner posts 7 being provided on the front side next to the door 22, and with a rinse-liquid tank 6 being provided in each of these front posts 7. It lies within the scope of the invention for a rinse-liquid tank 6 to have a capacity of between 10 L and 70 L, preferably between 15 L and 60 L, and especially preferably between 30 L and 55 L. Preferably, the two rinse-liquid tanks 6 of the corner posts 7 that are advantageously provided on the front side of the toilet stall have the same capacity or substantially the same capacity and this capacity may be between 40 and 50 L.

According to a preferred embodiment, a solar panel 29 is mounted on the upper surface of the roof 2 of the toilet stall 4. For example, the pump 15 of the toilet stall 4 can be powered by the solar panel 29, and, in addition or alternatively, the vent fan 8 can be powered by the solar panel 29. In principle, the solar panel 29 can also supply other electrical functional devices with power that are provided in the toilet stall 4 or that are provided inside one of the hollow support corner posts 7 of the toilet stall 4.

I claim:

1. A portable toilet stall for a sanitary fixture, the portable stall comprising:

a floor;

a roof above the floor;

a plurality of upright posts extending between the roof and the floor, two of the posts being hollow;

a plurality of side wall panels between the posts and also between the roof and the floor;

a respective rinse-liquid tank formed inside each of the hollow support posts and each having an output connection and an outlet conduit connected to the sanitary fixture; and a coupling between the outlet conduits and the fixture for feeding liquid from both of the tanks to the fixture.

2. The portable toilet stall defined in claim 1, wherein the roof and floor are polygonal and have corners between which the posts extend.

3. The portable toilet stall defined in claim 2, wherein there are four of the posts.

4. The portable toilet stall defined in claim 1, further comprising:

a vent fan inside one of the posts.

5. The portable toilet stall defined in claim 1, wherein each of the hollow support posts is hollow over at least 40% of its vertical length.

6. The portable toilet stall defined in claim 1 wherein each rinse-liquid tank extends over only 10% to 90% of a length of the respective hollow support post.

7. The portable toilet stall defined in claim 1, wherein each rinse-liquid tank is formed in a lower portion of the respective hollow support post adjacent the floor.

8. The portable toilet stall defined in claim 1, wherein each output connection is provided generally at a lower end of the respective rinse-liquid tank or of the respective hollow corner post.

9. The portable toilet stall defined in claim 1, therein each rinse-liquid tank has at least one fill port accessible from inside the toilet stall and at an upper end of the rinse-liquid tank.

10. The portable toilet stall defined in claim 1, wherein each rinse-liquid tank has a capacity of between 10 L and 70 L.

11. The portable toilet stall defined in claim 1, further comprising an openable and closable door between the two hollow posts.

12. A portable toilet stall for a sanitary fixture, the portable stall comprising:

a floor;

a roof above the floor;

a plurality of upright posts extending between the roof and the floor, two of the posts being hollow;

a plurality of side wall panels between the posts and also between the roof and the floor;

a respective rinse-liquid tank inside each of the hollow support posts, connected to the sanitary fixture, and each having an output connection connected to an outlet conduit, the output connection being provided generally at a lower end of the rinse-liquid tank or of the respective hollow corner post; and a coupling between the outlet conduits and the fixture for feeding liquid from both of the tanks to the fixture.

13. The portable toilet stall defined in claim 12, wherein the sanitary fixture is a toilet, a urinal, or a sink and is provided inside the toilet stall.

14. The portable toilet stall defined in claim 12, further comprising:

a pump between the coupling and the fixture for conveying rinse liquid from the tank to the fixture.

15. A portable toilet stall for a sanitary fixture, the portable stall comprising:

a floor;

a roof above the floor;

a plurality of upright posts extending between the roof and the floor, at least one of the posts being hollow;

a plurality of side wall panels between the posts and also between the roof and the floor;

a rinse-liquid tank inside the hollow support post, connected to the sanitary fixture, and having a fill port accessible from inside the toilet stall and at an upper end of the rinse-liquid tank;

an internally threaded fitting at the fill port; and an externally threaded screw plug fittable into the fitting to block same.

16. The portable toilet stall defined in claim 15, wherein the screw plug is provided with an actuating formation facilitating screwing of the plug into and out of the fitting.

* * * * *